US006622413B1

(12) United States Patent
Bickett

(10) Patent No.: US 6,622,413 B1
(45) Date of Patent: Sep. 23, 2003

(54) SIGHT APPARATUS FOR A SHOTGUN

(76) Inventor: Kim D. Bickett, 13475 Round Pond Rd., Shawneetown, IL (US) 62984

( * ) Notice: Subject to any disclaimer, the term of this patent is extended or adjusted under 35 U.S.C. 154(b) by 0 days.

(21) Appl. No.: 09/557,729

(22) Filed: Apr. 26, 2000

(51) Int. Cl.[7] ..... F41C 3/14
(52) U.S. Cl. ..... 42/112; 42/136
(58) Field of Search ..... 33/233, 254, 257; 42/100, 120, 126, 133, 136, 144, 112

(56) References Cited

U.S. PATENT DOCUMENTS

| | | | | | |
|---|---|---|---|---|---|
| 370,344 | A | * | 9/1887 | Long | 33/233 |
| 1,027,271 | A | | 5/1912 | Muller | |
| 1,223,476 | A | | 4/1917 | Coller | |
| 1,440,291 | A | | 12/1922 | Harkom | |
| 1,622,193 | A | | 3/1927 | Fischer | |
| 1,679,221 | A | | 7/1928 | Kelm | |
| 1,835,938 | A | | 12/1931 | Ewen | |
| 2,127,174 | A | | 8/1938 | Hunt | |
| 2,970,380 | A | * | 2/1961 | Hill | 33/233 |
| 3,112,566 | A | * | 12/1963 | Jones | 33/233 |
| 3,178,824 | A | * | 4/1965 | Callihoe | 33/233 |
| 4,010,564 | A | * | 3/1977 | Pettit | 42/1 |
| 4,102,053 | A | * | 7/1978 | Colwell | 33/233 |
| 4,117,617 | A | | 10/1978 | Linde et al. | |
| 4,143,465 | A | * | 3/1979 | White | 33/233 |
| 4,679,344 | A | | 7/1987 | Jolly | |
| 4,745,686 | A | * | 5/1988 | Willis | 33/254 |
| 4,976,038 | A | | 12/1990 | Nattrass | |
| 5,003,697 | A | * | 4/1991 | Hampton | 33/244 |
| 5,054,204 | A | * | 10/1991 | Ward et al. | 33/233 |
| 5,208,407 | A | | 5/1993 | Stover | |
| 5,561,563 | A | * | 10/1996 | Chesnut et al. | 359/823 |
| 6,327,806 | B1 | * | 12/2001 | Paige | 42/113 |

* cited by examiner

*Primary Examiner*—Michael J. Carone
*Assistant Examiner*—M. Thomson
(74) *Attorney, Agent, or Firm*—Barnes & Thornburg

(57) ABSTRACT

A sight apparatus for a shotgun includes a lens movable longitudinally and laterally with respect to the axis of the barrel so that the entire shot pattern at a given target distance for a given barrel choke is visible to the shooting eye of the shooter through the lens in a properly calibrated sight. The lens is colored so that a colored pattern indicative of the shot pattern is superimposed over a target at the given target distance. The mechanism providing for longitudinal and lateral adjustment of the lens relative to the axis of the barrel includes a longitudinally extending track pivotally mounted to the barrel adjacent the muzzle end. The track is formed to include a plurality of lateral slots within which tab extending from a frame holding the lens is received.

17 Claims, 3 Drawing Sheets

SIGHT APPARATUS FOR A SHOTGUN

BACKGROUND SUMMARY OF THE INVENTION

The present invention relates to a sight apparatus for a shotgun. More particularly, the present invention relates to an adjustable sight which is designed to provide an indication of a pattern of shot from the shotgun.

Shotguns may shoot individual slugs or loads of multiple projectiles called shot. Unless hunting large game, the preferred load for a shotgun is shot. These shot are carried in a shell configured for the gauge of the bore of the shotgun. Shells are available in different loads having different sizes, configurations, and numbers of projectiles. This shot is expelled from the smooth bore of the barrel of the shotgun. Upon exiting the bore of the shotgun, all the shot in a load has a component of velocity along the axis of the bore of the barrel. Each individual projectile also has a component of velocity perpendicular to the axis of the barrel. The magnitude of the component of velocity perpendicular to the axis of the barrel of any projectile is generally randomly distributed between zero and an upper limit. Thus as shot exits the barrel of a shotgun, each individual projectile travels longitudinally along the extended axis of the barrel toward the target and most of the individual projectiles also travel radially away from the extended axis in a random direction. Thus at any plane perpendicular to the extended axis, the shot is generally randomly distributed in a circular pattern.

The upper limit of the magnitude of the component of perpendicular velocity of any individual projectile is determined by the internal configuration of the bore and length of the barrel of the shotgun. The radius of the circular pattern through which substantially all of the shot pass at a given distance from the end of the barrel is determined by the upper limit of the magnitude of the component of perpendicular velocity of any individual projectile. The choke of a shotgun barrel refers to how effectively the barrel limits the magnitude of the component of perpendicular velocity of shot exiting the barrel, and thus also provides an indication of the expected diameter of the shot pattern at any given distance. A full-choke barrel minimizes the magnitude of the component of vertical velocity so that at a given distance the radius of the shot pattern is relatively small. An open-choke barrel does not limit the magnitude of the component of perpendicular velocity of shot exiting the barrel as well as a full choke barrel so that at any given distance the radius of the circular pattern through which the shot from an open-choke barrel passes is larger than that the radius of the circular pattern through which the shot from a full-choke barrel passes. Modified-choke barrels provide a pattern having a radius between the full-choke barrel and the open-choke barrel at any given distance.

Immediately upon leaving the barrel, projectiles propelled from firearms, are subject to wind resistance inhibiting the motion of the projectile along the axis of the barrel and gravity providing a substantially constant force on the projectile toward the earth. Thus sighting directly along the axis of the bore of the barrel, i.e. bore-sighting, does not provide a proper indication of where a projectile leaving the barrel will hit at a given distance. Sights for firearms generally provide a means for altering the height of a component of the sight so that the axis of the barrel is elevated relative to the sight line to compensate for gravitational forces and wind resistance. Sights are generally calibrated on a firing range so that the projectile leaving the barrel impacts the target within the sight at a given distance.

The sight apparatus of the present invention is calibrated for a particular shotgun. The sight is adjustable along a barrel of the gun to provide an indication of the pattern of shot at various distances. The sight is open and does not block the shooter's view. In other words, the shooter still has a full range of vision. The sight may be calibrated to shoot high or low depending on the preference of the shooter and on the gun. The colored lens of the sight apparatus provides an indication of the pattern of shot on a target, regardless of the distance of the target from the gun.

In accordance with the present invention, a sight apparatus for a shotgun having a barrel extending along a longitudinal axis, a muzzle end, and a defined choke inducing shot expelled from the barrel to fall within a defined shot pattern at a defined target distance, includes a lens and a frame coupled to the barrel for longitudinal and lateral movement relative to the longitudinal axis of the barrel. The lens is mounted to the frame and the frame and lenses are adjustable so that a shooting eye of a shooter will see the lens superimposed over the defined shot pattern when the sight apparatus is calibrated for the defined target distance. According to another aspect of the invention, the lens is colored. An additional aspect of the invention is that the entire shot pattern is visible to the shooting eye through the lens. According to yet another aspect of the invention, the longitudinal and lateral adjustment of the lens may be accomplished with a longitudinally extending track pivotally mounted to the barrel to pivot about a pivot point adjacent the muzzle end. The track includes a plurality of lateral slots and the frame is configured to be received in any one of the lateral slots.

A sight apparatus for a shotgun having a barrel having a longitudinal axis, a muzzle end, and a defined choke inducing shot expelled from the barrel to fall within a defined shot pattern at a defined target distance, includes a lens mounted to the barrel for longitudinal and lateral movement relative to the longitudinal axis. Additionally, the entire shot pattern is visible to the shooting eye through the lens when the sight apparatus is properly calibrated. Also, the lens is colored. The longitudinal displacement between the muzzle end of the barrel and the lens in a properly calibrated sight apparatus increases as the choke of the barrel becomes more open. The lateral displacement between the axis of the barrel and the lens in a properly calibrated sight apparatus increases as the target distance increases.

Additional features and advantages of the invention will become apparent to those skilled in the art upon consideration of the following detailed description of an illustrated embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
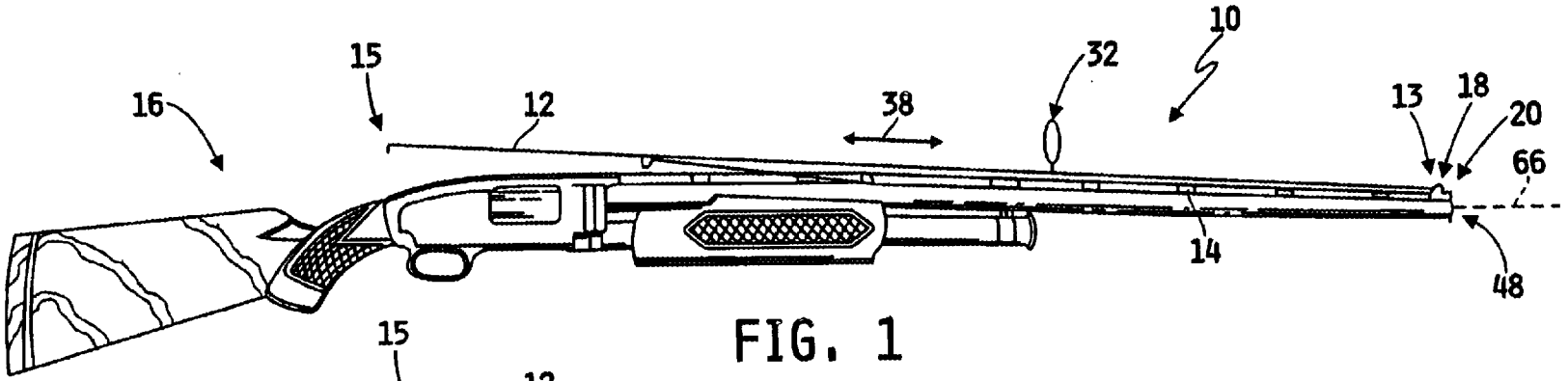
FIG. 1 is a side elevational view of a shotgun including a sight apparatus of the present invention.
Figure 2:
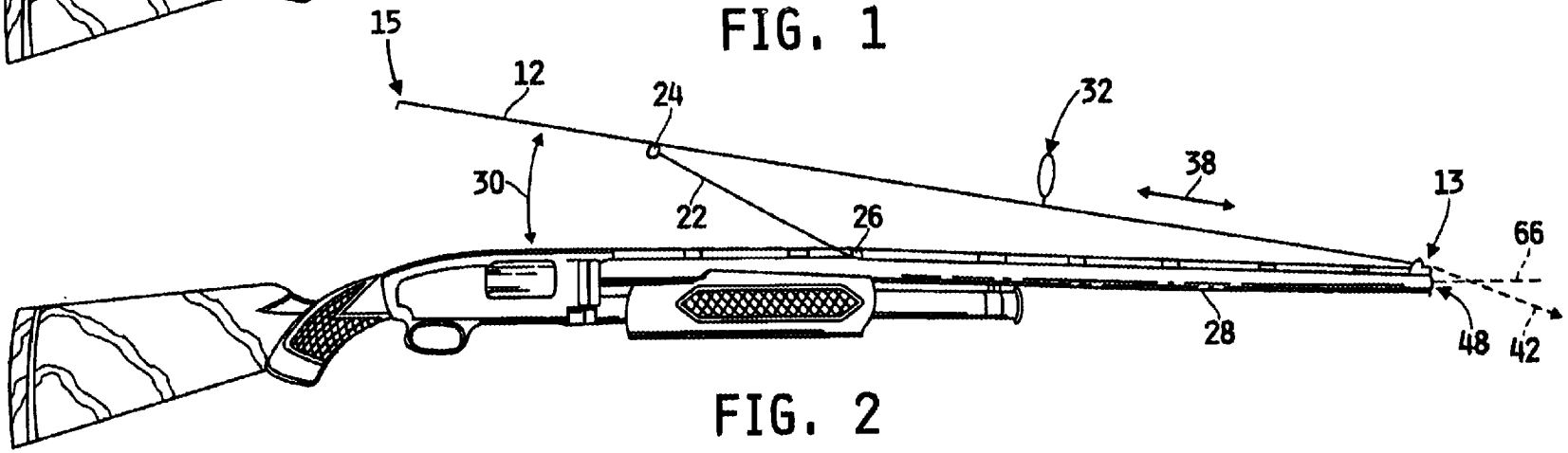
FIG. 2 is a side elevational view similar to FIG. 1 illustrating a track of the sight apparatus in an elevated position.

The present invention is illustrated in attached FIGS. 1–6. The sight apparatus 10 includes a track 12 pivotally mounted at a distal end 13 to a ventilated rib 14 of a shotgun 16 by pivot connection 18 located adjacent front bead 20. The track 12 is also pivotally coupled to the shotgun 16 by a link arm 22 having a first end pivotably coupled to the track 12 at location 24 between a proximate end 15 and the distal end 13 of the track 12 and a second end pivotably coupled to the ventilated rib 14 by pivot connection 26. The track 12 can be moved up and down relative to the barrel 28 of shotgun 16 in the direction of double-headed arrow 30 between a lower position shown in FIG. 1 and an elevated position shown in FIG. 2.

Figure 4:
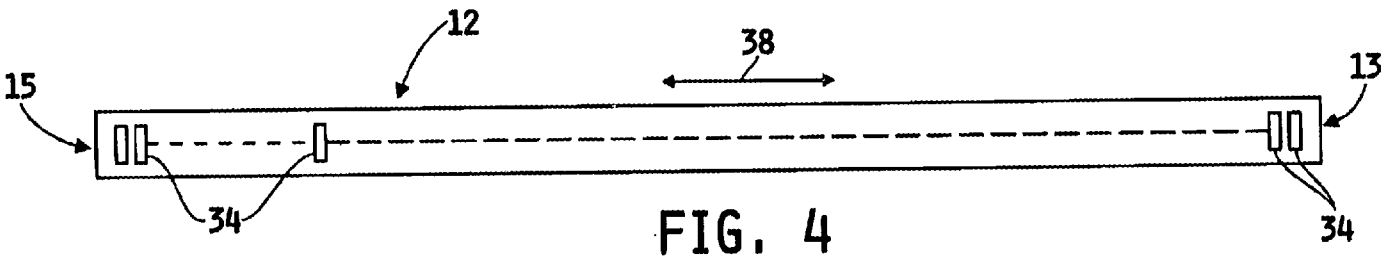
FIG. 4 is a top plan view illustrating one embodiment of the track of the present invention.
Figure 3:
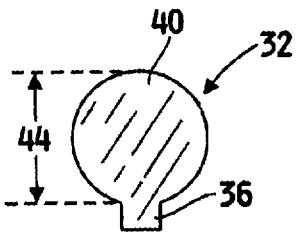
FIG. 3 is a front view of a sight configured to be coupled to the track.

A sight 32 is mounted on the track 12. Track 12 is illustrated in FIG. 4. Track 12 illustratively includes a plurality of slots 34 which provide a plurality of different mounting positions for the sight 32. The sight 32 is best illustrated in FIG. 3. The sight 32 includes a tab 36 configured to be located within one of the slots 34. Therefore, the location of sight 32 is adjustable along the length of track 12 in the direction of double-headed arrow 38. Sight 32 includes a round colored lens or sightglass portion 40. Tab 36 may be integrally formed with lens 40 or may be a portion of a frame acting as a lens holder.

The sight apparatus 10 is calibrated for each individual shooter. At a predetermined distance and choke setting, the shotgun 16 is fired and generates a predetermined pattern 50, 52, 54, 56 (See FIGS. 5 and 6) on a test target. The elevation of track 12 is then adjusted to be aligned with the bottom of the pattern on the target. In other words, the track 12 provides a line of sight to the bottom of the shot pattern 50, 52, 54, 56 created by the shotgun 16 along line 42. The position of sight 32 is then adjusted on the track 12 so that the round lens 40 covers the pattern 50, 52, 54, 56 of shot on the target when viewed by an operator in a shooting position. Therefore, the lens 40 provides a visual indication of the pattern of the shot from the gun 16. Once the sight apparatus 10 is calibrated, the operator uses the sight 32 to determine the location on a target that the pattern of the shot from the shotgun will cover.

Figure 5:
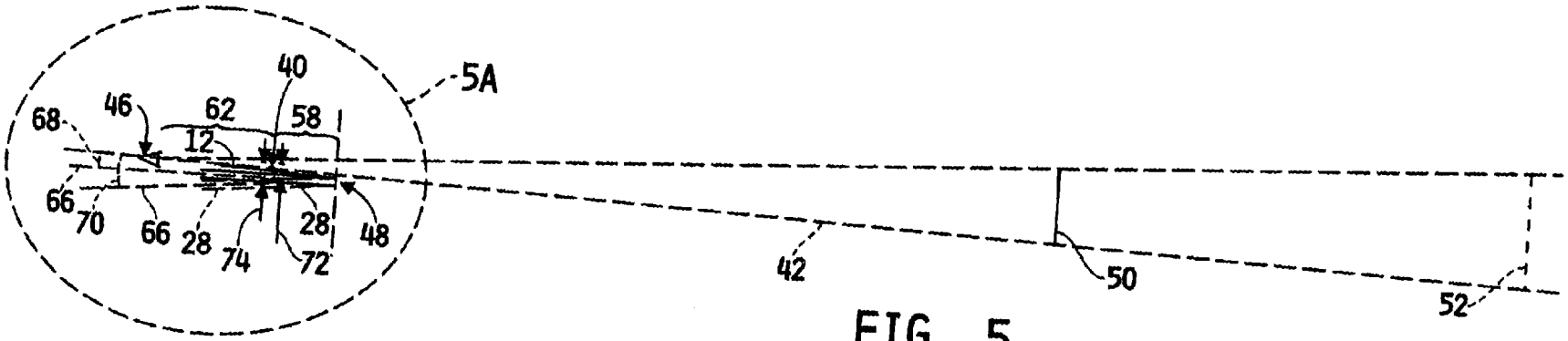
FIG. 5 is a diagrammatic view of a properly calibrated sight on a shotgun with a full-choke showing light rays in dotted lines passing through the lens of the sight so that the light from the top of the pattern passes through the top of the lens and the light from the bottom of the pattern passes through the bottom of the lens, a barrel and shot pattern shown in phantom lines provide an indication of how the angle between the track (or the center of the lens) and the barrel is increased to provide barrel elevation when the sight is properly sighted at a more distant target.
Figure 6:
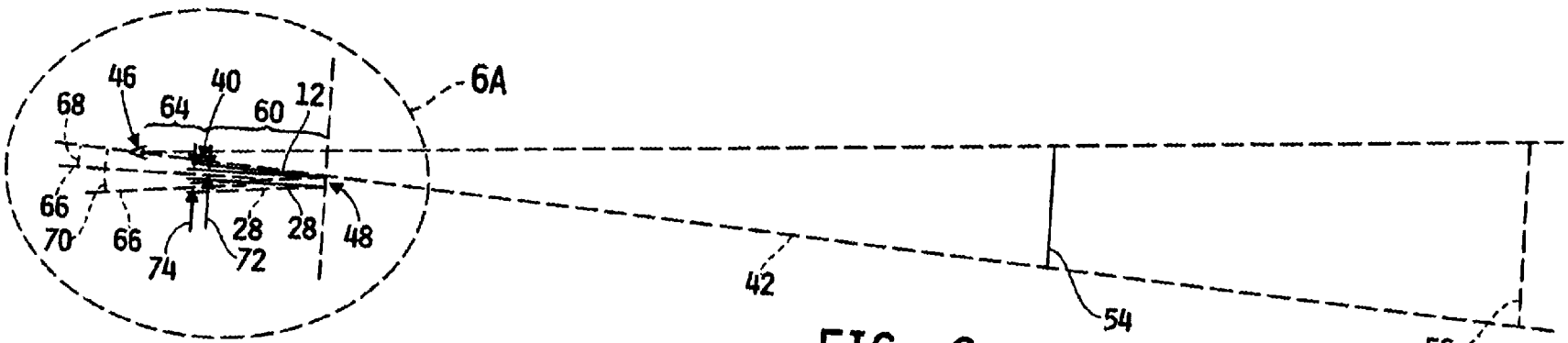
FIG. 6 is a diagrammatic view similar to FIG. 5 of a properly calibrated sight on a shotgun with an open-choke showing the larger shot pattern generated by an open-choke barrel and showing the lens positioned farther from the end of the barrel and closer to the shooter's eye than on the full-choke barrel when the sight is properly calibrated.

In preferred embodiments, lens 40 has a diameter 44 of approximately 7/16" or smaller. Lens 40 is also referred to as sight-glass 40 because, in preferred embodiments, lens 40 has flat surfaces and does not provide any magnification of the target. As shown in FIGS. 5 and 6 all light from a circular shot patterns 50, 52, 54, 56 at various distances for differing chokes pass through lens 40 to the shooting eye 46 of the shooter without the light rays being refracted, when the sight is properly calibrated.

Figure 5A:
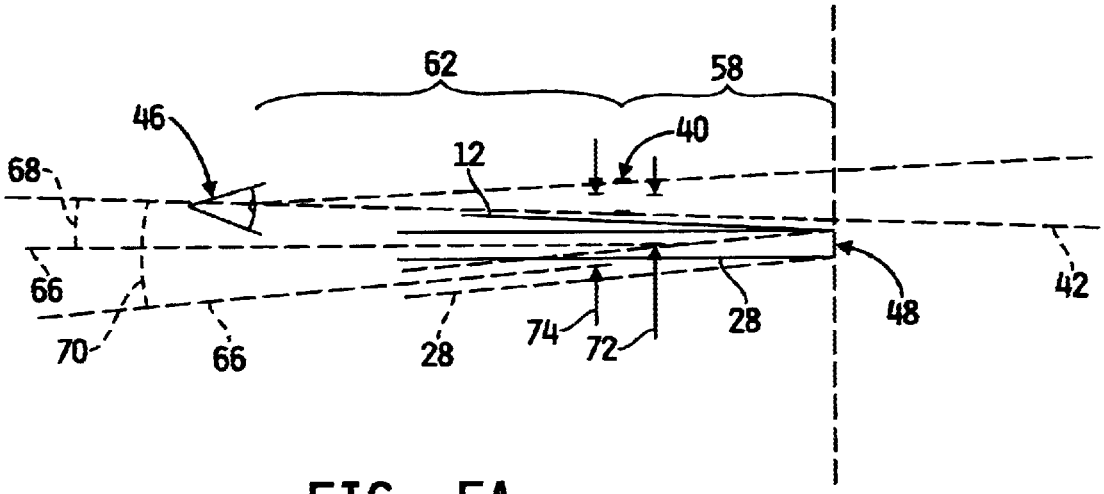
FIG. 5*a* is a magnified view of that portion of FIG. 5 contained in phantom circle 5*a* showing a shotgun with a full-choke and showing light rays in dotted lines passing through the lens of the sight so that the light from the top of the pattern passes through the top of the lens and the light from the bottom of the pattern passes through the bottom of the lens.
Figure 6A:
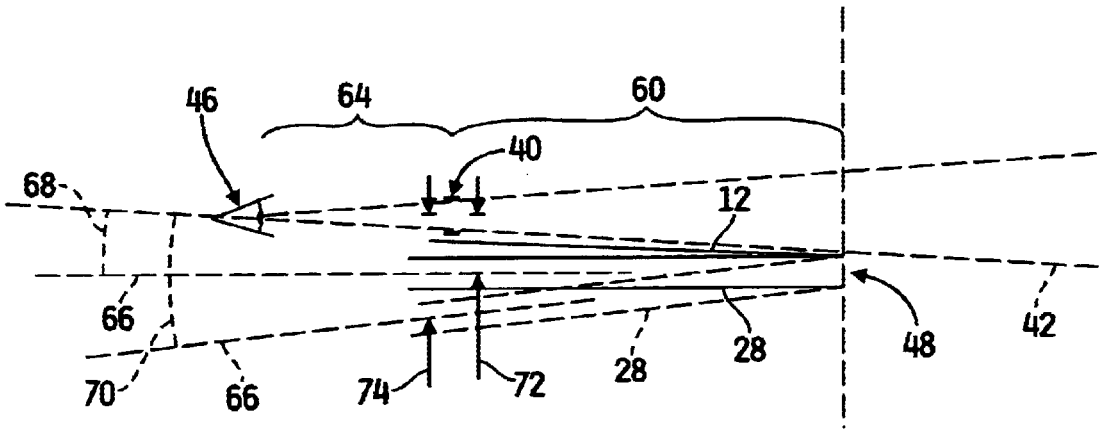
FIG. 6*a* is a magnified view of that portion of FIG. 6 contained in phantom circle 6*a* showing a shotgun with an open-choke and showing light rays in dotted lines passing through the lens of the sight so that the light from the top of the pattern passes through the top of the lens and the light from the bottom of the pattern passes through the bottom of the lens.

As shown in FIGS. 5, 5*a*, 6 and 6*a*, the sight apparatus 10 can be properly calibrated for barrels 28 having different chokes and can be calibrated for different target distances. FIGS. 5 and 5*a* illustrate the proper calibration of the sight apparatus 10 for a barrel 28 having a full-choke. FIGS. 6 and 6*a* illustrate the proper calibration of the sight apparatus 10 for a barrel 28 having an open-choke. Comparison of FIGS. 5 and 5*a* and FIGS. 6 and 6*a* shows that at any given distance the diameter of the shot pattern 50, 52 for a shotgun 16 having a full-choke is smaller than the diameter of the shot pattern 54, 56 for the shotgun 16 having the open-choke at the same distance. Also, as shown diagrammatically in FIGS. 5, 5*a*, 6 and 6*a*, when properly calibrated, the muzzle end 48 of the shotgun barrel 28 does not obstruct the shooter's view of the bottom of the shot pattern 50, 52, 54, 56.

FIGS. 5, 5*a*, 6 and 6*a* also indicate that distance 58 between the muzzle end 48 of the barrel 28 and lens 40 for a properly calibrated sight apparatus 10 on a full-choke barrel 28 is greater than the distance 60 between the muzzle end 48 of the barrel 28 and the lens 40 for a properly calibrated sight apparatus 10 on an open-choke barrel. Consequently the distance 62 between the shooting eye 46 of the shooter and the lens 40 is greater for a properly calibrated sight apparatus 10 on a full-choke barrel than the distance 64 between the shooting eye 46 of the shooter and the lens 40 for a properly calibrated sight apparatus 10 on an open-choke barrel. Thus movement of lens 40 along the longitudinal axis 66 of the barrel 28 adjusts the indicated pattern size seen through the sight 32 to compensate for the choke of the barrel 28. Those skilled in the art will recognize that a properly calibrated sight apparatus 10 on a modified-choke barrel would have the lens 40 located between the longitudinal locations shown in FIGS. 5, 5*a*, 6 and 6*a*.

The barrels 28 indicated in phantom lines in FIGS. 5, 5*a*, 6 and 6*a*, represent barrels 28 which are elevated relative to the sight line for properly calibrated sight apparatus 28 for the target distances shown by the shot patterns 52, 56 indicated in dotted lines in FIGS. 5, 5*a*, 6 and 6*a*. These phantom barrels 28 provide an indication of how the angle between the track 12 (or the center of the lens) and the barrel 28 is increased to provide barrel elevation when the sight apparatus is properly sighted at a more distant target 52, 56. Thus the angle 70 between the axis 66 of the barrel 28 and the track 12 for a properly calibrated sight apparatus 10 for a more distant target 52, 56 is greater than the angle 68 between the axis 66 of the barrel 28 and the track 12 for a properly calibrated sight apparatus 10 for a closer target 50, 54. Consequently, the lateral distance 74 between the center of the lens 40 and the axis 66 of the barrel 28 on a properly calibrated sight apparatus 10 for a more distant target 52, 56 is greater than the lateral distance 72 between the center of the lens 40 and the axis 66 of the barrel 28 on a properly calibrated sight apparatus 10 for a closer target 50, 54.

Although the illustrated embodiment of the sight apparatus 10 for a shotgun 16 utilizes a track 12 including lateral slots 34 to facilitate longitudinal adjustment of the displacement of lens 40 from the muzzle end 48 of the barrel 28 and the shooter's shooting eye 46 to properly calibrate the sight apparatus 10 to the choke of the barrel 28, other configurations of longitudinal adjustment mechanisms are within the teaching of the invention. For example, lens 40 can be coupled to a frame which slides within a longitudinal slot on a track extending along the length of the barrel 28. A set screw or a spring loaded mechanism can lock the frame in a desired location along the track. Similarly, longitudinal adjustment of the sight apparatus 10 can be accomplished by lens 40 being attached to a frame mountable directly to, and slidable along, the ventilated rib 14 of the barrel 28. Those skilled in the art will recognize other alternative mechanisms which facilitate longitudinal adjustment of the lens 40 as being within the scope of the invention as presently perceived.

Similarly, although the illustrated embodiment of the sight apparatus 10 for a shotgun 16 utilizes a track 12 pivotally mounted adjacent the muzzle end 48 of the barrel 28 and a pivot arm 26 to facilitate lateral adjustment of the displacement of lens 40 from the axis 66 of the barrel 28 to properly calibrate the sight apparatus 10 for varying target distances, other configurations of lateral adjustment mechanisms are within the teaching of the invention. For example, lens 40 can be coupled to a frame for lateral movement within a slot formed in the frame to facilitate adjustment of the displacement of the center of the lens 40 from the axis 66 of the barrel 28. A set screw or a spring loaded mechanism can lock the lens 40 in a desired location within the slot. Lens 40 could also be coupled to frame using a screw mechanism so that rotation of the screw adjusts the displacement of lens 40 from the axis 66 of the barrel 28. Those skilled in the art will recognize other alternative mechanisms which facilitate lateral adjustment of the lens 40 relative to the axis 66 of the barrel 28 as being within the scope of the invention as presently perceived.

Although the invention has been described in detail with reference to certain preferred embodiments, additional variations and modifications exist within the scope and spirit of the invention as described and defined in the following claims.

What is claimed is:

1. A sight apparatus for a shotgun having a barrel having a longitudinal axis, a muzzle end, and a defined choke inducing shot expelled from the barrel to fall within a defined shot pattern at a defined target distance, the sight apparatus comprising:

a lens, a frame coupled to the barrel for longitudinal and lateral movement relative to the longitudinal axis of the barrel, and wherein the lens is mounted to the frame and the frame and lens are adjustable so that a shooting eye of a shooter sees the lens superimposed over the defined shot pattern when the sight apparatus is calibrated for the defined target distance.

2. The sight apparatus of claim 1 in which the lens is colored.

3. The sight apparatus of claim 1 wherein the entire shot pattern is visible to the shooting eye through the lens.

4. The sight apparatus of claim 1 further comprising a longitudinally extending track pivotally mounted to the barrel.

5. The sight apparatus of claim 4 wherein the track is mounted to the barrel to pivot about a pivot point adjacent the muzzle end.

6. The sight apparatus of claim 4 wherein the track includes a plurality of lateral slots and the frame is configured to be received in any one of the lateral slots.

7. The sight apparatus of claim 6 wherein the track is mounted to the barrel to pivot about a pivot point adjacent the muzzle end.

8. The sight apparatus of claim 7 in which the lens is colored.

9. The sight apparatus of claim 8 wherein the entire shot pattern is visible to the shooting eye through the lens.

10. A sight apparatus for a shotgun having a barrel having a longitudinal axis, a muzzle end, and a defined choke inducing shot expelled from the barrel to fall within a defined shot pattern at a defined target distance, the sight apparatus comprising a lens, a mount mounted to the barrel and coupled to the lens, said mount including means for longitudinal and lateral movement of the lens relative to the longitudinal axis wherein the lens is adjustable so that a shooting eye of a shooter sees the lens superimposed over the defined shot pattern when the sight apparatus is calibrated for the defined target distance.

11. The sight apparatus of claim 10 wherein the entire shot pattern is visible to the shooting eye through the lens when the sight apparatus is properly calibrated.

12. The sight apparatus of claim 11 in which the lens is colored.

13. The sight apparatus of claim 11 wherein a longitudinal displacement between the muzzle end of the barrel and the lens in a properly calibrated sight apparatus increases as the choke of the barrel becomes more open.

14. The sight apparatus of claim 11 wherein a lateral displacement between the axis of the barrel and the lens in a properly calibrated sight apparatus increases as the target distance increases.

15. The sight apparatus of claim 14 wherein a longitudinal displacement between the muzzle end of the barrel and the lens in a properly calibrated sight apparatus increases as the choke of the barrel becomes more open.

16. The sight of claim 15 in which the lens is colored.

17. A sight apparatus for a shotgun having a barrel having a longitudinal axis, a muzzle end, and a defined choke inducing shot expelled from the barrel to fall within a defined shot pattern at a defined target distance, the sight apparatus comprising a colored translucent lens and a mount adapted to be coupled to the shotgun and coupled to the lens to permit longitudinal and lateral movement of the lens relative to the longitudinal axis whereby the lens is adjustable so that a shooting eye of a shooter sees the lens superimposed over the defined shot pattern when the sight apparatus is calibrated for the defined target distance.

* * * * *